US005913263A

United States Patent [19]

Hruska

[11] Patent Number: 5,913,263

[45] **Date of Patent: *Jun. 22, 1999**

[54] DEVICE AND METHOD FOR STRETCHING A SCREEN ON A ROLLER FRAME

[75] Inventor: Jerome J. Hruska, Branson, Mo.

[73] Assignee: Stretch Devices, Inc., Philadelphia, Pa.

[ * ] Notice: This patent is subject to a terminal disclaimer.

[21] Appl. No.: 08/880,485

[22] Filed: Jun. 23, 1997

Related U.S. Application Data

[63] Continuation of application No. PCT/US95/16830, Dec. 22, 1995.

[51] Int. Cl.[6] ..... B41L 15/00

[52] U.S. Cl. ..... 101/114; 101/128.1

[58] Field of Search ..... 101/114, 127.1, 101/128.1, 128.4, 129, 407.1, 408, 415.1, 474, 378; 269/30–34, 1, 2, 25, 26; 38/102.5, 102.6, 102.7, 102.9, 102.91, 102, 102.1

[56] References Cited

U.S. PATENT DOCUMENTS

| | | | |
|---|---|---|---|
| 2,608,750 | 9/1952 | Cluzel . | |
| 3,601,912 | 8/1971 | Dubbs . | |
| 3,910,185 | 10/1975 | Brasa . | |
| 4,462,174 | 7/1984 | Messer Schmitt . | |
| 4,525,909 | 7/1985 | Newman | 29/121.1 |
| 4,571,864 | 2/1986 | Bopp . | |
| 4,995,178 | 2/1991 | Randolph . | |
| 5,063,842 | 11/1991 | Clarke . | |
| 5,113,611 | 5/1992 | Rosson . | |
| 5,127,176 | 7/1992 | Newman | 38/102.1 |
| 5,129,171 | 7/1992 | Arbter et al. | 38/102.2 |
| 5,148,745 | 9/1992 | Hamu | 101/102.1 |
| 5,235,908 | 8/1993 | Froelicher et al. . | |
| 5,390,596 | 2/1995 | Farr . | |
| 5,522,314 | 6/1996 | Newman, Jr. | 101/127.1 |
| 5,606,911 | 3/1997 | Cane | 101/127.1 |
| 5,676,052 | 10/1997 | Wegrzyn et al. | 101/127.1 |

FOREIGN PATENT DOCUMENTS 2 028 721 3/1980 United Kingdom .

OTHER PUBLICATIONS

"Newman Roller Master™", Stretch Devices, Inc. advertisement (Model PB1).

"Newman Roller Master™", Stretch Devices, Inc. advertisement (Model C–3).

*Primary Examiner*—Eugene Eickholt

*Attorney, Agent, or Firm*—Seidel, Gonda, Lavorgna & Monaco, P.C.

[57] ABSTRACT

A device for stretching a screen on a roller frame includes at least three torsion stations and a support structure. Each torsion station includes a torsion tool, for example, a wrench head, which can be attached to one end of one of the sides of the frame and torqued for the purpose of stretching the screen. Each torsion tool is attached to a shaft structure at a first pivot point. Each shaft structure is attached to the support structure at a second pivot point. Each shaft structure has a pneumatic or hydraulic cylinder positioned intermediately along its length for altering the length of the shaft structure between its first and second pivot points, thereby causing the wrench head to torque and rotate one of the rollers of the frame. A control panel allows the operator to activate all of the pneumatic cylinders simultaneously and with substantially equal forces, thereby resulting in a more rapidly and evenly stretched screen.

22 Claims, 5 Drawing Sheets

DEVICE AND METHOD FOR STRETCHING A SCREEN ON A ROLLER FRAME

This application is a continuation of PCT/US95/16830 filed Dec. 22, 1995.

FIELD OF THE INVENTION

The invention relates to screen printing. In particular, the invention involves a device for rapidly and evenly stretching a screen on a roller frame.

BACKGROUND OF THE INVENTION

The widely practiced art of screen printing generally involves the application of inks through taughtly stretched screens or meshes. For this purpose, a screen is typically stretched over, and fixed on, a rectangular (sometimes square) frame. There are two general types of frames which have gained common acceptance in the trade. First, there are frames designed for a single use. These frames are often made of wood. The screen is usually glued to the wood after being stretched over the frame. Second, there are frames which are designed for repeated use. These frames are often referred to as "roller frames". Each of at least three sides (usually four sides) of a roller frame typically includes a cylindrical roller, a groove running substantially along the length of the roller, a bolt-like end portion which can be torqued by a wrench, and a locking mechanism for controlling the rotational freedom of the roller. One such roller frame is referred to as a Newman Roller™, and is sold by Stretch Devices of Philadelphia. Another such roller frame is sold by Diamond Chase Company, Inc. of Huntington Beach, Calif. The present invention involves the second-mentioned type of frame, i.e., reusable roller frames.

Up until now, the conventional method of stretching a screen on a roller frame is a manual process requiring the following steps: (1) the screen is placed in the frame and secured to the frame by urging the mesh into the roller grooves, then inserting a dowel or flexible strip into each of the grooves; (2) the frame is placed on a table with the screen side down; (3) a wrench is applied to a bolt-like end portion of one of the sides of the frame, and torqued, thus stretching the screen; (4) a jam bolt is tightened to prevent the roller from further turning; (5) steps 3 and 4 are repeated sequentially for each of the other sides of the frame; and (6) the frame is then turned over and the tension of the screen is tested. This process is typically repeated two to five times before the proper tension for the screen is achieved. This manual process of stretching a screen on a roller frame usually takes between 5 and 45 minutes, depending on the skill of the operator.

There are at least four significant problems and/or limitations with the use of roller frames and manually stretched screens. First, the period of time required to manually stretch a screen on a roller frame (5–45 minutes) is considered by many in the industry, to be too long to make the use of roller frames cost effective. Second, a flat frame is hard to achieve and/or maintain with the manual stretching process. However, frame flatness is critical for proper printing registration. Third, with the manual process, it is difficult to achieve the proper tension in both directions (weft and warp). However, it is critical for precision printing, that the screen be stretched to the proper tension in both directions. Fourth, the ability to manually stretch the screen on a roller frame is highly dependent on the skill and experience level of the operator.

Accordingly, a primary objective of the present invention, is to provide a more rapid way of stretching a screen on a roller frame. Another object of the invention is to provide a method of stretching a screen on a roller frame which is not appreciably dependent on the manual skill of the operator. Still another object of the invention is to provide a device which is capable of stretching a screen, with proper tension in both directions, and on a roller frame which remains flat.

SUMMARY OF THE INVENTION

The above stated objectives are achieved with the present invention which provides a device for stretching a screen on a rectangular roller frame. Such a roller frame has four sides. Each of at least three of the sides of the frame has a cylindrical roller, an end portion, and a locking mechanism for controlling the rotational freedom of the roller. The device of the present invention includes first, second and third torsion stations. Each torsion station is located at a corner of a rectangular work area, and includes a torsion tool member shaped and dimensioned to mate with the end portion of one of the sides of the frame so that torquing movement of the tool causes rotation of the roller. The torsion tool is attached to a shaft structure at a first pivot point. Each torsion station a has support structure to which the shaft structure is attached at a second pivot point. The length of each shaft structure between the first and second pivot points is variable for the purpose of rotating the respective torsion tool and corresponding roller on the roller frame.

In a preferred embodiment of the invention the support structure is a table. Each of the shaft structures are attached to a part of the table at the second pivot point. A fourth torsion station is also provided so that each of the four corners of the rectangular work area has a torsion station. Each of the torsion tools is or includes a wrench head and each of the end portions of the frame has opposing flat surfaces, or is "bolt-like" and dimensioned to be gripped by one of the wrench heads. Each of the shaft structures has a pneumatically powered cylinder positioned intermediately between the first and second pivot points. Each of the pneumatic cylinders is operable to vary the length of the shaft structure between the first and second pivot points, thereby causing the torsion tool to torque one of the rollers on the roller frame.

In another embodiment of the invention each of the torsion stations is supported by a separate table. This embodiment is specifically designed for stretching screens on exceptionally large frames.

The present invention also provides a new method of stretching a screen on a rectangular roller frame. First, a screen is attached along substantially the entire length of each of the rollers on a roller frame. Next, a torsion tool as attached to each of the end portions of the frame. The torsion tools are then pneumatically or hydraulically torqued equally and simultaneously so that the screen is evenly and rapidly stretched over the frame. The locking mechanisms are then activated so that the rollers are prevented from rotating and the stretched state of the screen is maintained.

DETAILED DESCRIPTION OF INVENTION

Figure 1:
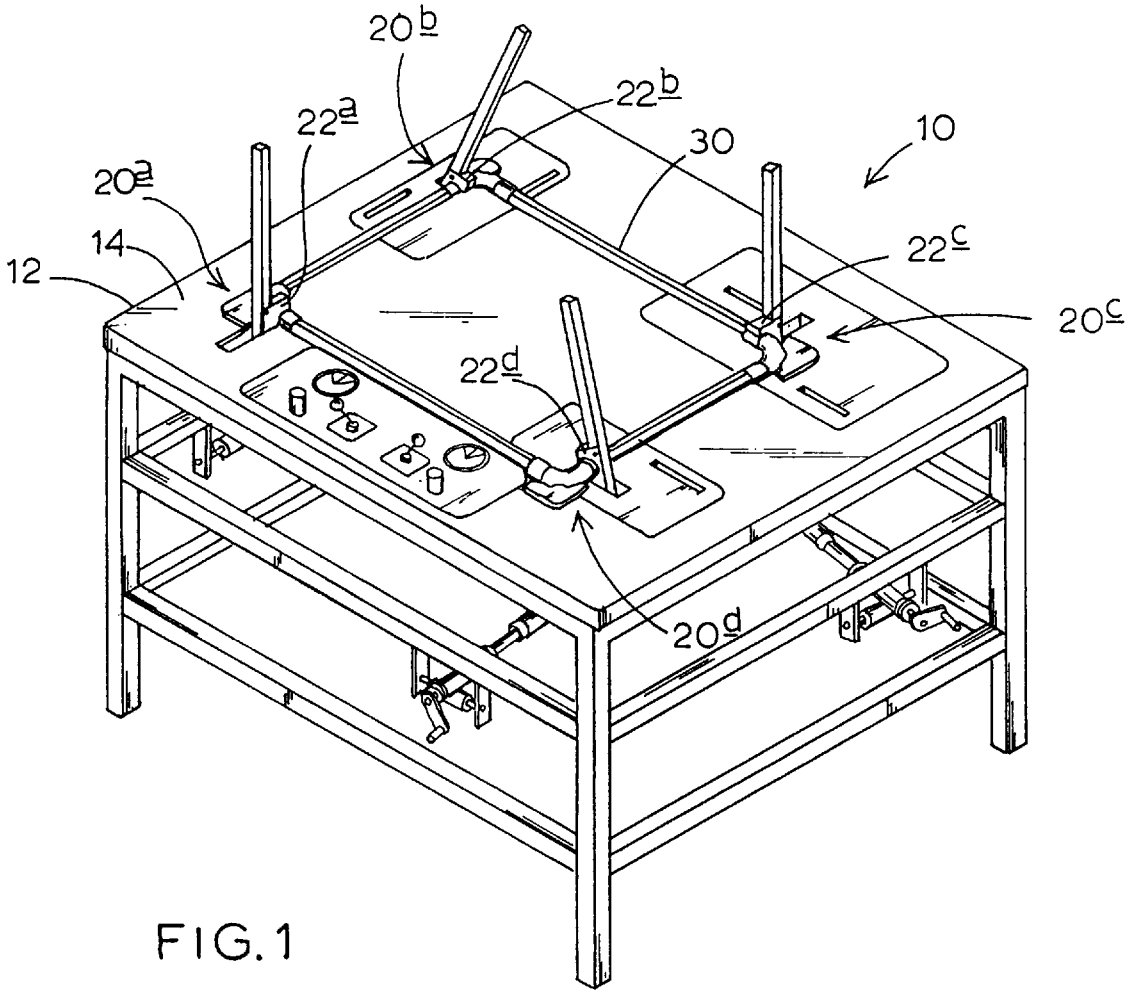
FIG. 1 is a perspective view of a screen stretching device in accordance with a preferred embodiment of the present invention.

FIG. 1 shows a preferred embodiment of the present invention. The device 10 includes a table 12 which has a top surface 14 and a rectangular work area 16 defined on the top surface 14. Torsion stations 20*a*, 20*b*, 20*c* and 20*d* are located at or near the four corners of work area 16. The particular type of torsion station which is employed in the device illustrated in FIG. 1, may also be referred to as a "wrenching station" because the stations employ wrench heads 22*a*, 22*b*, 22*c* and 22*d* to torque, i.e., cause rotation of the cylindrical rollers which form the sides of roller frame 30. Further details of the device shown in FIG. 1 will now be described with reference to FIGS. 2–5.

Figure 2:
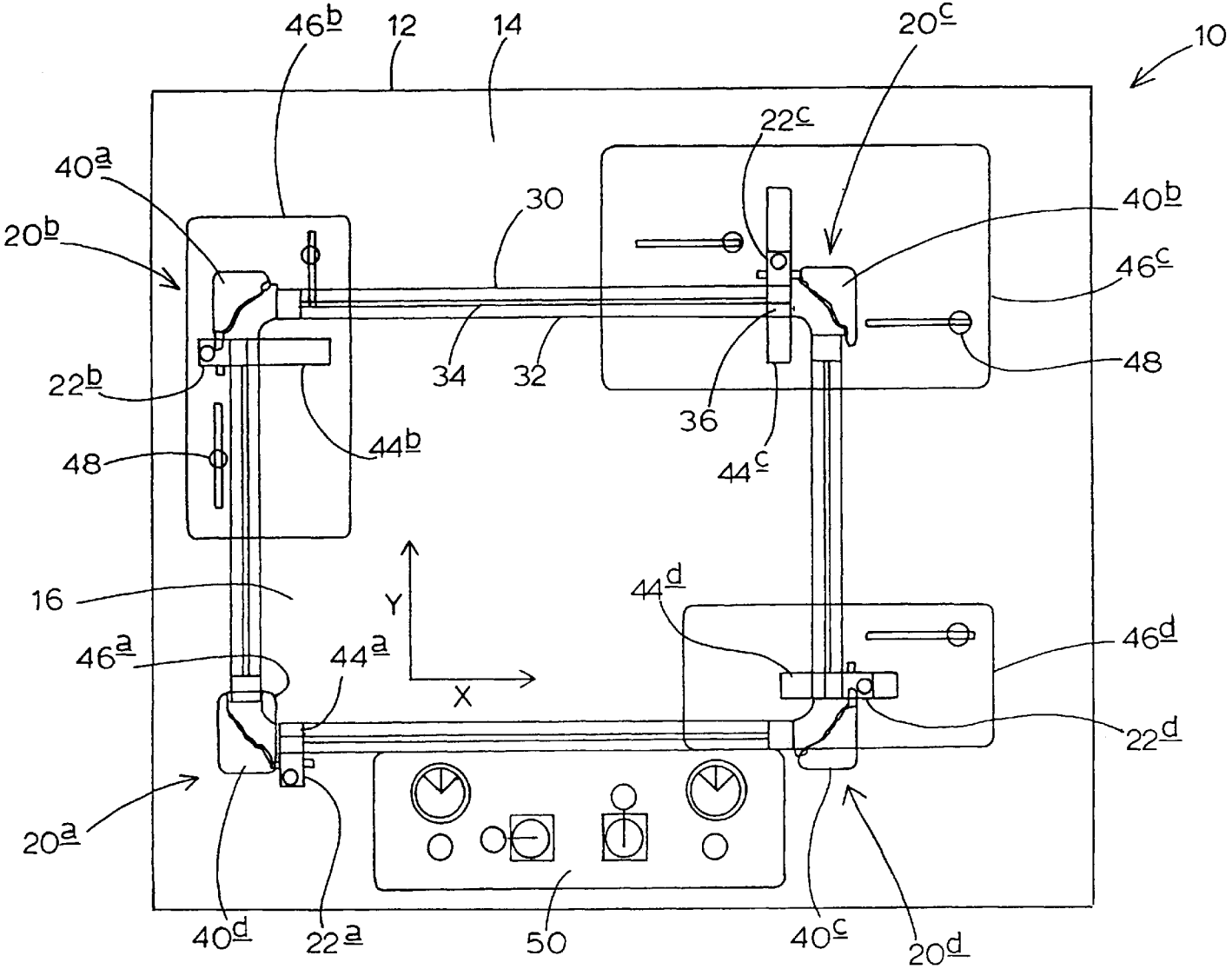
FIG. 2 is a top view of the device shown in FIG. 1.

As shown in FIG. 2, roller frame 30 has four sides. Each side of roller frame 30 has a groove, such as 34, running substantially along the entire length of roller 32. The groove is used to fasten the screen to the cylinder before stretching. The screen material is fastened to the cylinder by urging the screen into the groove, then inserting a dowel or flexible strip into the groove. At least one end of roller 32 has an end portion, such as 36, which is configured to be gripped by wrench 22*c*. Most commonly, roller frames have two end portions on each side of the frame. The end portions are essentially "bolt-like" in that they have opposing flat surfaces which can be gripped by an open ended wrench. Each side of frame 30 also has a locking mechanism (not shown), for example, a "jam bolt" which screws in the end of the roller in the direction parallel with the core of the roller. Tightening of the jam bolt essentially locks or prevents further rotation of the cylinder.

Frame 30 is held in place on work area 16 by frame stops 40*a*, 40*b*, 40*c* and 40*d*. Each of the wrenching stations has a slot 44*a*, 44*b*, 44*c* and 44*d* through which wrench heads 22*a*, 22*b*, 22*c* and 22*d*, respectively, connect to shaft structures which will be described in more detail below. Note that slots 44*a*, 44*b*, 44*c* and 44*d* are actually larger than what is shown in FIG. 2. The bottom view (FIG. 4) shows the actual relative dimensions of the slots. In FIG. 2, portions of slots 44*b*, 44*c* and 44*d* are covered by station plates 46*b*, 46*c* and 46*d*. Each torsion station has a station plate 46*a*, 46*b*, 46*c* and 46*d*. However, station plate 46*a* of station 20*a* (also referred to as station #1) is different from the other station plates because it is fixed, i.e., non-movable with respect to its X-Y position on top surface 14 and work area 16. Station plate 46*b* at station 20*b* (also referred to as station #2) is movable in the Y direction, but not in the X direction. In a similar fashion, station plate 46*c* of station 20*c* (also referred to as station #3) is movable in both the X direction and the Y direction. Station plate 46*d* of torsion station 20*d* (also referred to as station #4) is movable in the X direction, but not the Y direction.

Wrench heads 22*b*, 22*c* and 22*d* move with their respective station plates. The purpose of providing for movement of the wrenching stations is to provide flexibility for stretching screens on roller frames of different sizes. Slits are provided through which bolts such as 48 are used to fix and maintain the X-Y is location of station plate 46*b*.

A control panel 50 is provided with switches that allow the operator to activate the wrenches.

The side view shown in FIG. 3 reveals the pneumatically driven shaft structures which are mounted below the table and are operable to cause the wrenches to rotate.

Beginning at station 1, wrench head 22*a* has a handle 59*a* which is not essential, but is helpful for allowing the operator to attach the wrench head to an end portion of a roller frame. As better shown in FIG. 4, wrench head 22*a* extends through slot 44*a* of the table, and is attached to shaft structure 60*a* at a first pivot point (not shown). Shaft structure 60*a* includes an intermediately disposed pneumatic cylinder 62*a*. The other end of shaft structure 60*a* is attached to a crossbar of the table (or an extension thereof) at a second pivot point 68*a*.

Similarly, at station 2 wrench head 22*b* has a handle 59*b*. Wrench head 22*b* extends through slot 44*b* in the table, and is attached to shaft structure 60*b* at a first pivot point 61*b*. Shaft structure 60*b* includes pneumatic cylinder 62*b* and extends to second pivot point 68*b* where shaft structure 60*b* is attached to a bracket which is mounted on a part of the table.

At station 3, wrench head 22*c* has a handle 59*c*. Wrench head 22*c* extends through slot 44*c* in the table top, and is attached to shaft structure 60*c* at a first pivot point (not shown). Shaft 60*c* includes pneumatic cylinder 62*c* which is operable to vary the length of shaft structure 60*c* between its first and second pivot points during the screen stretching process. Shaft structure 60*c* extends to second pivot point 68*c* where shaft structure 60*c* is attached to a bracket which is mounted on a crossbar of the table. A crank 73*c* allows the operator to manually adjust the length of the shaft structure, thereby altering the location of the wrench along the Y axis in the work area. The width of the bracket at pivot point 68*c* is wide enough to allow wrench 22*c* to be moved along the X axis of the work area.

At station 4, wrench head 22*d* has a handle 59*d*. Wrench head 22*d* extends through slot 44*d*, and is attached to shaft structure 60*d* at a first pivot point 61*d*. Shaft structure 60*d* includes pneumatic cylinder 62*d* and extends to a second pivot point 68*c* where shaft structure 60*d* is attached to a bracket which is mounted on a crossbar of the table. Valve 64 on pneumatic cylinder 62*d* provides for connection to a compressed gas source. Valve 66 allows gas to enter or exit the cylinder. Similar to previously described crank 70*c*, crank 70*d* allows the operator to vary the length of shaft structure 60*d*, thereby altering the position of wrench head 22*d* along the X axis in the work area.

Figure 3:
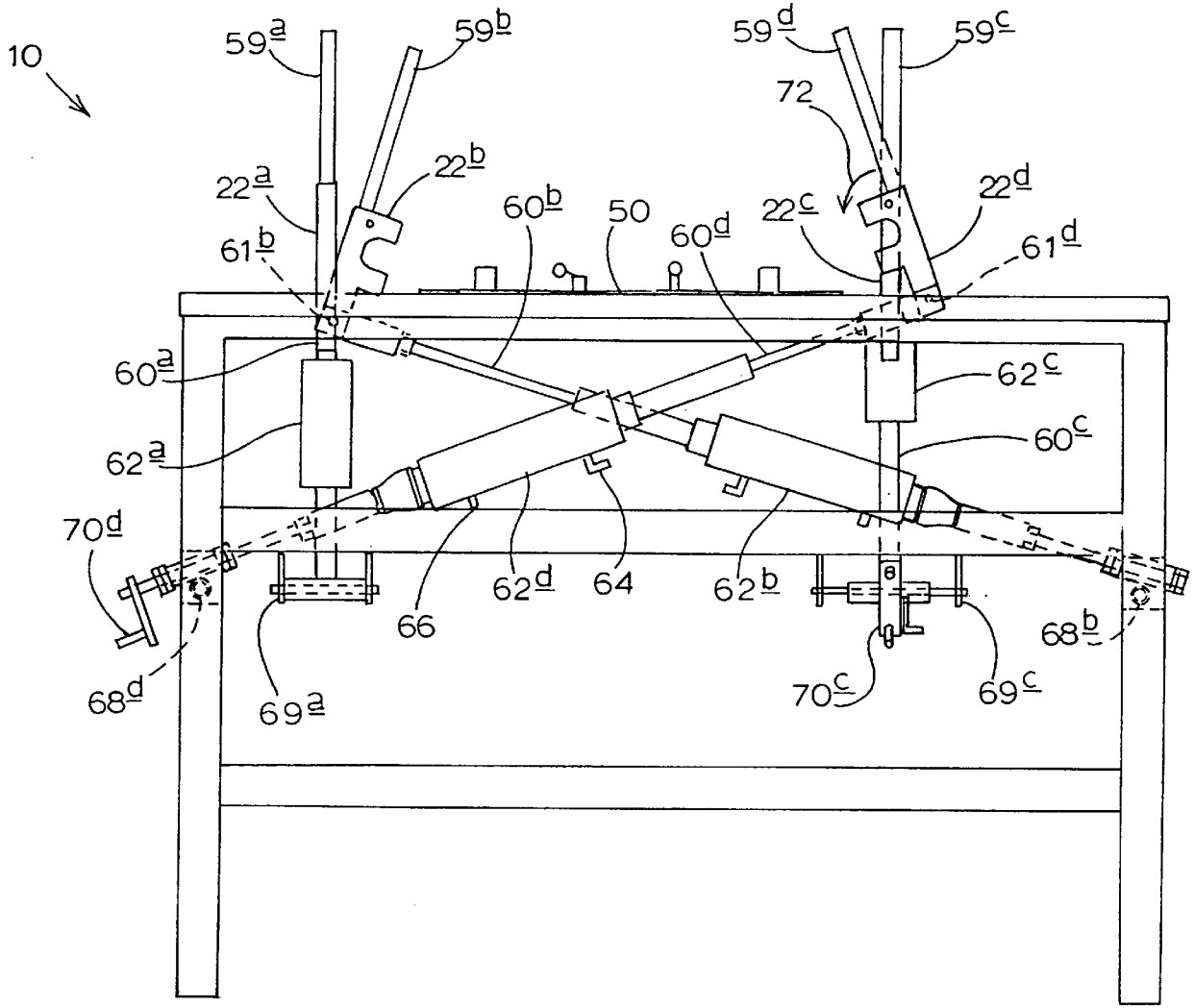
FIG. 3 is a side view of the device shown in FIGS. 1 and 2.

As clearly shown in FIG. 3 with respect to station 4, when pneumatic cylinder 62*d* extends, pivoting occurs at first pivot point 61*d*, thereby causing wrench head 22*d* to rotate in a counterclockwise direction, as shown by arrow 72.

Bach of pneumatic cylinders 62*a*, 62*d*, 62*c* and 62*d* are preferably connected, via the control panel, to a single gas source. The operator activates the cylinders by manipulating switches on control panel 50.

Figure 4:
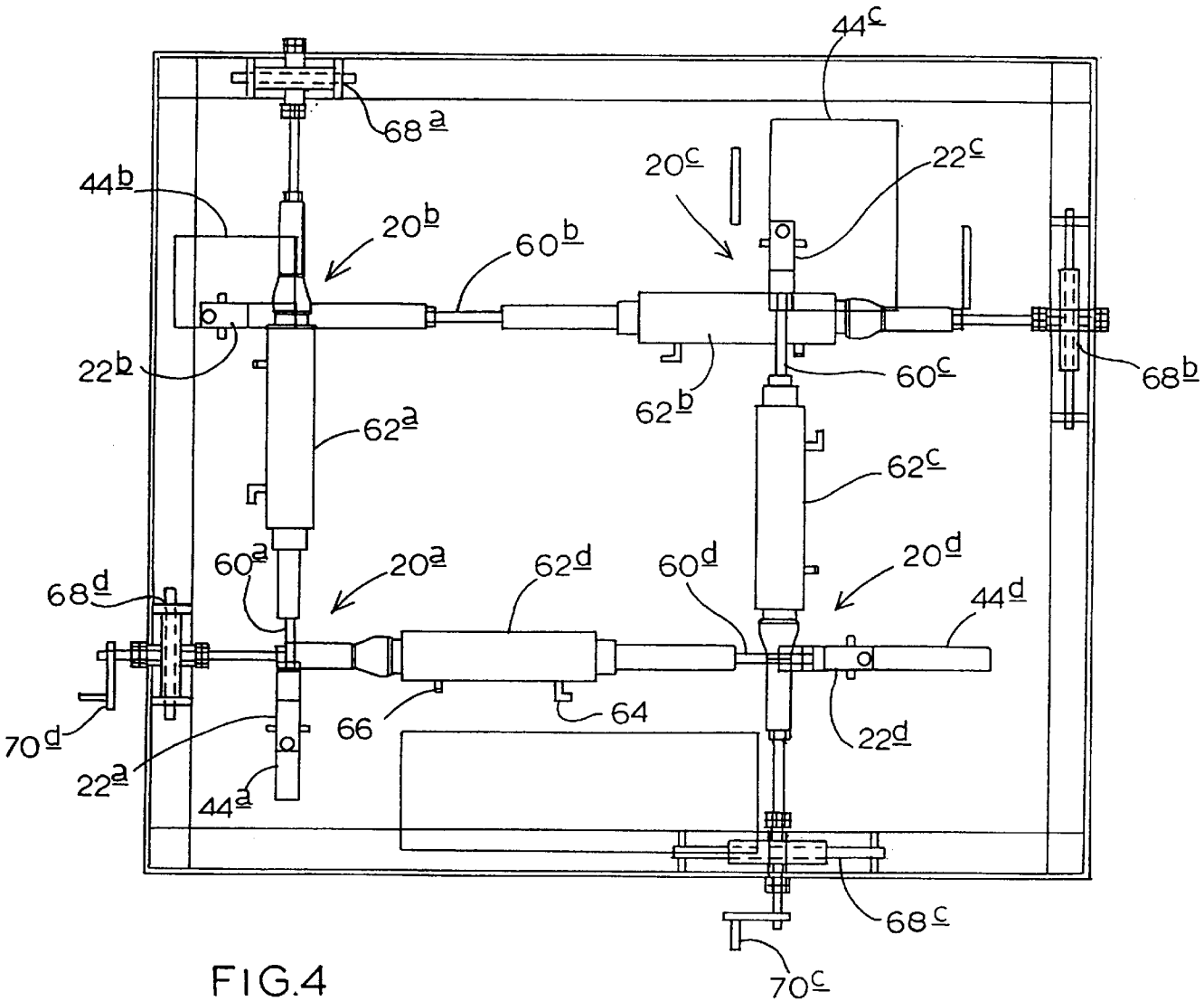
FIG. 4 is a bottom view of the device shown in FIGS. 1–3.

FIG. 4 shows the same shaft structures which were described above with reference to FIG. 3, and additionally shows features of shaft structures 60*a* and 60*c*, of stations 1 and 3, respectively, which were not visible in the side view of FIG. 3.

Figure 5:
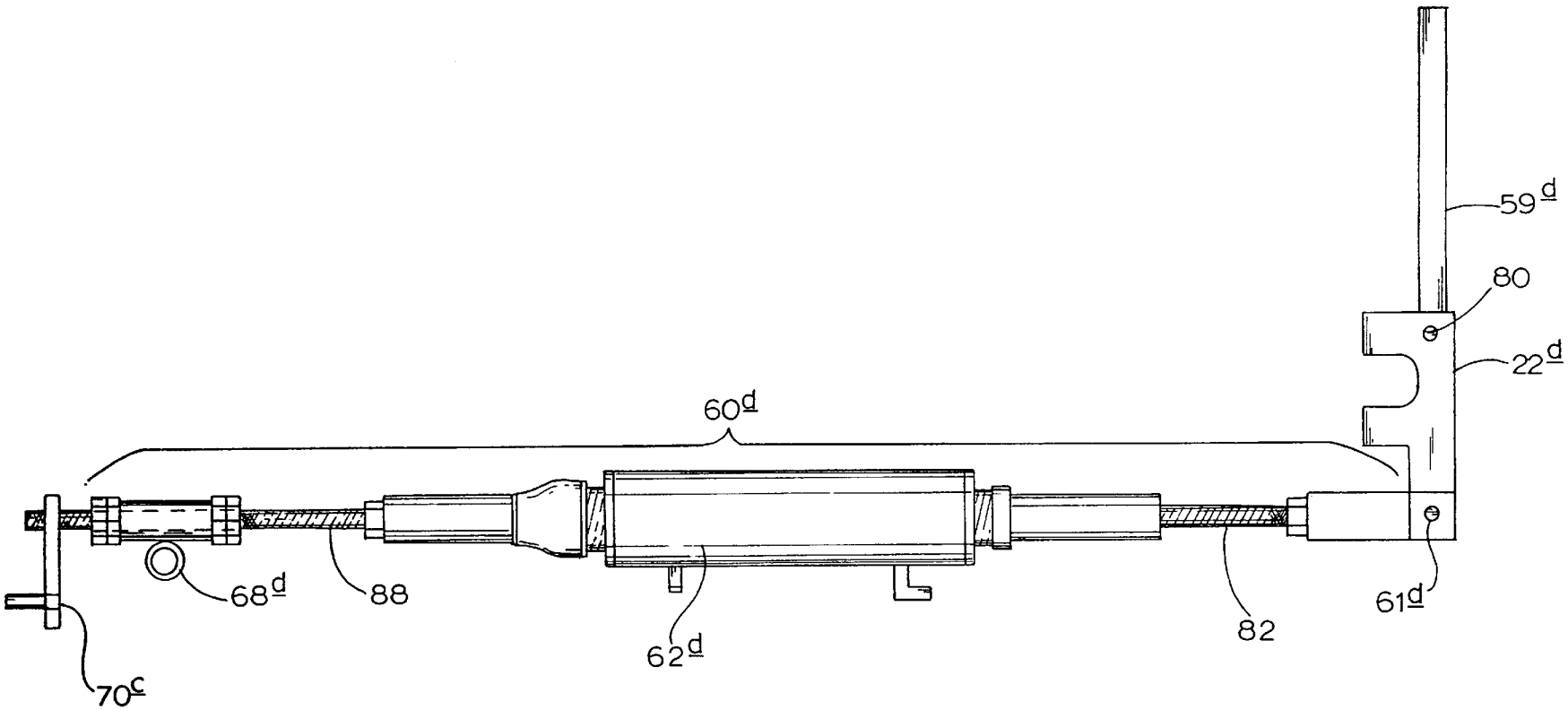
FIG. 5 is an isolated side view of a wrench attached to a shaft structure, including an intervening pneumatic cylinder, in accordance with the preferred embodiment of the present invention.

FIG. 5 is an isolated view of the wrench and shaft structure associated with station 4. Handle 59*d* is attached to wrench head 22*d* by a pin 80. Wrench head 22*d* is attached to shaft structure 60*d* at pivot point 61*d*. Moving along shaft structure 60*d* from first pivot point 61*d* toward second pivot point 68*d*, a shaft 2 has a threaded end portion, and is connected to pneumatic cylinder 62*d*. On the other end of pneumatic cylinder 62*d*, threaded rod 88 extends toward second pivot point 68*d*. As already explained, adjustment handle or crank 70*c* is provided to permit the operator to manually adjust the overall length of shaft structure 60*d* between first and second pivot points, thereby altering the position of wrench head 22*d* along the X axis of the work area.

Applicant has described a specific embodiment of the present invention. However, it is apparent that many variations and modifications may be made to the described device without departing from the spirit and scope of the invention as set forth in the claims below. For example, depending on the type of roller frame which is used, different types of torsion tools may be employed. A roller frame may be constructed to have an end portion with a female opening. For such a frame, the torsion tools should have a complimentary male structure analogous to an alien or socket wrench.

Further, I have described a device with four torsion stations and four wrenches. However, on some roller frames, only three of the sides have rollers. For these frames, it is only necessary to have three torsion stations.

Another variation of the invention which is particularly useful for large frames, is a device which has a separate table for each torsion station. This way, the tables, i.e., torsion stations, can be easily and independently moved to accommodate large frames of various sizes.

I claim:

1. A device for stretching a screen on a rectangular roller frame having four sides, each side of the roller frame having a cylindrical roller, a groove running substantially along the length of the roller, an end portion with two opposing flat surfaces, and a locking mechanism for controlling the rotational freedom of the roller, the device comprising:

a base member having a top surface and a rectangular work area deemed on the top surface for supporting the roller frame while the screen is being stretched over the roller frame;

first, second, third and fourth wrenching stations located on the work area and adapted to engage an end portion of one of the rollers in the roller frame, the wrenching stations including a wrench head with opposing faces spaced to compliment the opposing flat surfaces of the end portion on one of the sides of the roller frame, the wrench head being attached to an actuator for rotating the respective wrench head and corresponding roller on the roller frame.

2. The device of claim 1 wherein actuators include a pneumatic or hydraulic cylinder and the actuators are connected to the wrench heads so that extension and contraction of the cylinder causes the wrench head to rotate.

3. The device of claim 2 further comprising a gas source for powering the cylinders.

4. The device of claim 3 further comprising a control panel including at least one switch for activating the cylinders, thereby causing the four cylinders to rotate simultaneously and with substantially equal torque.

5. A device for stretching a screen on a rectangular roller frame having four sides, each of at least three of the sides of the frame having a cylindrical roller, an end portion, and a locking mechanism for controlling the rotational freedom of the roller, the device comprising:

first, second and third torsion stations, each torsion station located at a corner of a rectangular work area, and including a torsion tool member shaped and dimensioned to mate with the end portion of one of the sides of the frame so that torquing movement of the tool causes rotation of the roller, the torsion tool being attached to an actuator for causing rotation of the torsion tool member; and each torsion station having a support structure to which the actuator is attached, the length of the actuator being variable for the purpose of rotating the respective torsion tool and corresponding roller on the roller frame.

6. The device of claim 5 further comprising a fourth torsion station so that each of the rollers of the roller frame has a torsion station and a corresponding torsion tool for causing rotation of the rollers.

7. The device of claim 5 wherein each of the torsion tools is an open-ended wrench head and each of the end portions of the frame has opposing flat surfaces dimensioned to be gripped by the wrench head.

8. The device of claim 5 wherein each of the torsion tools includes a male structure and each of the end portions of the frame has a female opening for receiving the male structure so that torsional movement of male structure causes the respective roller to rotate.

9. A method of stretching a screen on a rectangular roller frame having four sides, each of at least three of the sides of the frame having a cylindrical roller, an end portion, and a locking mechanism for controlling the rotational freedom of the roller, the method comprising the steps of:

attaching a screen along substantially the entire length of each of the rollers on the roller frame;

attaching a torsion tool to each of the end portions of the frame;

pneumatically or hydraulically torquing all of the torsion tools equally and simultaneously so that the screen is evenly stretched over the frame; and activating the locking mechanisms so that the rollers are prevented from rotating and the stretched state of the screen is maintained.

10. A device for stretching a screen secured to a rectangular roller frame having four sides which are joined to one another at four corners, at least three sides of the roller frame being formed by a cylindrical roller, and a locking mechanism for controlling the rotational freedom of the rollers, the device comprising:

a work area for receiving and supporting the roller frame while the screen is being stretched, at least three wrenching stations, each wrenching station located on the work area to rotate one side of the roller frame, a wrench member provided at each wrenching station, each wrench member shaped and dimensioned to engage a roller in the roller frame so that the wrench member may cause rotation of the roller, and torquing means for causing each wrench member to rotate and torque the respective rollers, thereby stretching the screen on the roller frame.

11. The device as claimed in claim 10 wherein each of the wrenching stations are located at a corner of the work area.

12. The device as claimed in claim 11 further comprising a series of support pads for supporting the corners of the roller frame.

13. The device as claimed in claim 12 wherein one of the wrenching stations is fixed on the work area.

14. The device as claimed in claim 13 wherein at least two of the wrenching stations are moveable relative to the fixed wrenching station so that the work area may adjust to accommodate different size roller frames.

15. The device as claimed in claim 10 wherein each of the torquing means further comprises a pneumatic or a hydraulic operated cylinder.

16. The device as claimed in claim 15 wherein each of the cylinders are mechanically connected to the wrench members to cause the wrench members to rotate and torque the respective roller.

17. The device as claimed in claim 16 wherein each of the cylinders torque and rotate the wrench members equally to create uniform torsion in the rollers so that the screen is evenly stretched.

18. A device for stretching a screen on a roller frame, the roller frame having four sides, at least three of the sides of the frame being formed by a cylindrical roller adapted for rotation about its longitudinal axis, the rollers rotatably mounted at each end to a corner member, each of the rollers having means thereon for securing a side edge of the screen material to a roller, at least one end portion of each roller having a bolt-like engagement surface, and the ends of the rollers having a locking mechanism for releasably affixing the rotational position of the roller, the device comprising:

a first, second and third wrenching station, each wrenching station located at a corner of a work area for supporting the roller frame, each wrenching station including a wrench mechanism having a wrench surface for engaging the bolt-like engagement surface of the end portion of the roller and for causing rotation of the roller about its longitudinal axis, and an actuator for causing the wrench mechanism to rotate and torque the engaged roller, thereby stretching the screen on the roller frame.

19. The device as claimed in claim 18 wherein the actuator further comprises a pneumatic or a hydraulic cylinder mechanically connected to the wrench mechanism such that, upon actuation of the actuator, each wrench mechanism will rotate and torque the respective roller equally to create uniform tension in the screen.

20. The device as claimed in claim 18 further comprising a fourth wrenching station having a wrench mechanism, the wrench mechanism having a wrench surface for engaging the bolt-like engagement surface of the end portion of a roller on the fourth side of the roller frame.

21. The device as claimed in claim 20 wherein at least two of the wrenching stations are moveable relative to the other wrenching stations, respectively, so that the device may adjust to accommodate different size roller frames.

22. A device for stretching a screen on a roller frame, the roller frame having four sides, each of the sides of the frame formed by a cylindrical roller, the rollers rotatably mounted at each end to a corner member, each of the rollers having means thereon for securing a side edge of the screen material to the roller, at least one end of each roller having an engagement surface, and the ends of the rollers having a locking mechanism for releasably fixing the rotational freedom of the roller, the device comprising:

a work area for supporting the roller frame, at least three wrenching stations, one of which is located at a corner of the work area, another of which is located at an opposite corner of the work area and another of which is located at a corner of the work area diagonal to at least one of the previous wrenching stations, a wrench head provided at each wrenching station, each wrench head adapted to engage one of the engagement surfaces of the rollers, a cylinder operatively attached to each of the wrench heads to cause the wrench head to rotate its engaged roller, and a control panel having a means therein for activating each of the cylinders equally to cause the wrench heads to rotate and torque the respective rollers to create uniform tension in the screen, thereby stretching the screen in the roller frame equally.

* * * * *